US005399385A

United States Patent [19]

Joos et al.

[11] Patent Number: 5,399,385

[45] Date of Patent: Mar. 21, 1995

[54] CURTAIN COATER SLIDE HOPPER WITH IMPROVED TRANSITION PROFILE AND METHOD

[75] Inventors: F. Miguel Joos, Pittsford; Kenneth J. Ruschak, Rochester, both of N.Y.

[73] Assignee: Eastman Kodak Company, Rochester, N.Y.

[21] Appl. No.: 72,831

[22] Filed: Jun. 7, 1993

[51] Int. Cl.[6] ..... B05D 1/30

[52] U.S. Cl. ..... 427/420; 118/324; 118/DIG. 4

[58] Field of Search ..... 427/420; 118/DIG. 4, 118/324

[56] References Cited

U.S. PATENT DOCUMENTS

| | | | |
|---|---|---|---|
| 3,289,632 | 12/1966 | Barstow | 118/412 |
| 3,508,947 | 4/1970 | Hughes | 118/324 |
| 3,915,606 | 10/1975 | Straub et al. | 425/113 |
| 4,019,906 | 4/1977 | Ridley | 427/420 |
| 4,046,104 | 9/1977 | Stuhlman | 118/300 |
| 4,109,611 | 8/1978 | Fahrni et.al. | 118/325 |
| 4,135,477 | 1/1979 | Ridley | 118/325 |
| 4,222,343 | 9/1980 | Zimmermann et al. | 118/325 |
| 4,384,015 | 5/1983 | Koepke et al. | 427/420 |
| 4,398,665 | 8/1983 | Bryant et al. | 239/193 |
| 4,500,039 | 2/1985 | Pacifici et al. | 239/193 |
| 4,510,882 | 4/1985 | Prato | 118/300 |
| 4,922,851 | 5/1990 | Morikawa et al. | 118/324 |
| 4,942,068 | 7/1990 | Schweicher et al. | 427/420 |
| 5,044,307 | 9/1991 | Takahashi et al. | 118/325 |

FOREIGN PATENT DOCUMENTS

| | | | |
|---|---|---|---|
| 107818A | 5/1984 | European Pat. Off. | 118/DIG. 4 |
| 891787 | 3/1962 | United Kingdom | 118/DIG. 4 |
| 1574241 | 9/1980 | United Kingdom . | |

OTHER PUBLICATIONS

T. Baumeister, E. A. Avallone and T. Baumeister III, "Marks' Standard Handbook for Mechanical Engineers", McGraw-Hill, 8th Edn., 1978, pp. 2–45 to 2–46 (no month date).

L. D. Landau and E. M. Lifshits, "Fluid Mechanics", Pergamon, 1959, p. 231 (no month date).

*Primary Examiner*—Shrive Beck
*Assistant Examiner*—Katherine A. Bareford
*Attorney, Agent, or Firm*—Carl F. Ruoff

[57] ABSTRACT

The present invention minimizes the effects of capillary and inertial forces on the film profile for a slide hopper, thereby making the film profile smooth and predictable even when the transition section is short. The invention enables improved coating uniformity over the main width of the coating and particularly at the edges. The slide hopper has a slide surface and a lip surface, with a transition surface connecting the two surfaces. The transition surface profile has a variable curvature that is zero at the first end, increases continuously to a maximum at a point between the first and second ends and decreases continuously to zero at the second end.

10 Claims, 7 Drawing Sheets

CURTAIN COATER SLIDE HOPPER WITH IMPROVED TRANSITION PROFILE AND METHOD

FIELD OF THE INVENTION

The present invention concerns a curtain coating method and apparatus which produces improved uniformity in the coated product.

BACKGROUND OF THE INVENTION

Curtain coating is a very efficient method of manufacturing precision coatings of multiple layers. There are a number of patents that describe the method, such as U.S. Pat. No. 3,508,947. In the curtain coating process, particularly when multiple layers are involved, it is critical that the thickness of each layer remain uniform over the width of the web. There are several problems that can cause layer nonuniformities before the liquid layers meet the web. For example, problems can occur at the inlets and outlets of the liquid layers flowing over the slide. Here, the liquid layers emerge from the slots onto the slide and the film thickness becomes variable in the direction transverse to the average flow. Another problem area is the precise shape of the lip from which the liquid film plunges into free fall as a curtain. Here, a contact line between the slide (solid), the liquid and the air (gas) is formed and the shape of the lip is a critical part in ensuring that the contact line is always straight. An example of a patent which describes these problems is U.S. Pat. No. 4,109,611.

Another problem area is found along each of the two sides of the hopper's slide, where the liquid's free surface meets a solid surface. These solid surfaces at the edge of the coating liquid layers must be carefully designed so that the free surface i.e., the upper interface of the top layer, remains approximately flat right up to the solid edge. This is described in U.S. Pat. No. 3,289,632. One approach to achieve this result is to design the solid surface as an edge pad with its height substantially the same as the liquid film thickness. The free surface is then pinned to the corner of the edge pad and maintains a substantially flat free surface over the width of the slide. The same approach can be used on a vertical flat section which ends at the lip where the coating liquids plunge into free fall. A related issue is that edge pads produce better results if they are continuous. Further information on apparatus for continuous edging can be found in W094/08272. Discontinuities in the height of the edge pads introduce flow disturbances that can produce layer thickness non-uniformities. It is inferred from this that besides being of substantially the same height as the liquid film, it is best that any difference in height between the edge pad and the adjacent liquid film vary slowly.

The problem that the present invention addresses is improving the uniformity of the liquid film's edge on the slide hopper by the matching of edge pads and the liquid film's free surface along the transition section of the slide hopper. In the transition section, the film thickness changes from a thicker film on a moderately inclined main slide to a thinner film on a much steeper slide which leads to the hopper lip. The moderate and steep inclined slide sections are inclined with respect to the horizontal between 5° and 30°, and 60° to 120°, respectively. The way this transition occurs can be quite complex, depending on the physical conditions of the film (flow rate, viscosity, surface tension, density) and the geometry of the transition section (length scale and shape of the section). For instance, standing waves are usually present near both ends of the transition section. These waves vary in amplitude and length scale making it very difficult to design an edge pad for the transition section that handles the many flow conditions encountered. The object of this invention is, therefore, to create a transition section on which edge pads can be mounted that will handle flow variations, as long as the initial film thickness is substantially the same. Furthermore, the film thickness along the transition section should be predictable and the length of the transition section should be sufficiently large so that edge pads can be reliably manufactured and mounted on the hopper slide surface. However, the transition section size should be reasonably short so as to reduce the possibility of creating non-uniformities in the coating due to other disturbances such as interfacial waves in multilayer film or air currents impinging on the slide surface.

Prior art transition sections are disclosed in U.S. Pat. Nos. 4,109,611 and 4,510,882. These patents describe transition sections that are sections of circular cylinders with large radii of curvature, between 20 and 50 mm. According to these patents, transition sections with large radii of curvature improve curtain stability and reduce disturbances along the lip. However, these patents fail to recognize the problem of non-uniformities along the sides of the transition section. Another prior art patent, UK 1,574,241 proposes a transition section of variable slope, preferably of a parabolic shape, of about 5 to 7 inches long for coaters with a short curtain drop i.e., less than 1 inch. The authors of that patent maintain that the variable slope accelerates the flow down the slide by such a degree that it enables the coater to enjoy the advantages of curtain coaters with substantially higher drops.

These prior art devices achieve slow changes in film thickness along their transition section. Thus, along the transition it is quite possible that the thickness of the film meets the goals of smooth and predictable film thickness variation and independence of the thickness from other flow conditions. However these sections are longer than desirable, and if they are shortened to their lowest recommended size, 20 mm, it can be inferred from the results given in the examples of the present invention that standing waves will appear near both ends of the transition section.

SUMMARY OF THE INVENTION

The present invention is an apparatus and method for curtain coating a moving support with one or more layers of a coating liquid. The curtain coater includes a hopper means having a slide surface and a lip surface, the lip surface terminating in a lip for forming a free falling curtain of coating liquid. The hopper means has a transition surface connecting the slide surface at a first end and a lip surface at a second end. The transition surface profile has a variable curvature that is zero at the first end, increases continuously to a maximum at a point between the first and second ends and decreases continuously to zero at the second end.

In a preferred embodiment, the apparatus has a variable radius of curvature which is determined by the formula:

$$\frac{1}{R} = \frac{3\tan\theta}{L}$$

-continued $$\frac{(2+n)(3+n)\left[\left(\frac{\sin\theta_1}{\sin\theta_0}\right)^{\frac{1}{3}}-1\right]\left(1-\frac{s}{L}\right)^{1+n}\frac{s}{L}}{1+\left[\left(\frac{\sin\theta_1}{\sin\theta_0}\right)^{\frac{1}{3}}-1\right]\left(1-\frac{s}{L}\right)^{2+n}\left[(2+n)\frac{s}{L}+1\right]}$$

wherein

R=the variable radius of curvature;

$\theta$=the local angle of inclination of the slide with respect to the horizontal;

$\theta_0$=the angle of inclination at the first end of the transition surface;

$\theta_1$=the angle of inclination at the second end of the transition surface;

s=the arclength distance along the transition surface, starting at the first end;

L=the arclength of the entire transition surface; and n=a positive number.

For a better understanding of the present invention, together with other and further objects, advantages and capabilities thereof, reference is made to the following disclosure and appended claims in connection with the above-described drawings.

DETAILED DESCRIPTION OF THE PREFERRED EMBODIMENT

Figure 1:
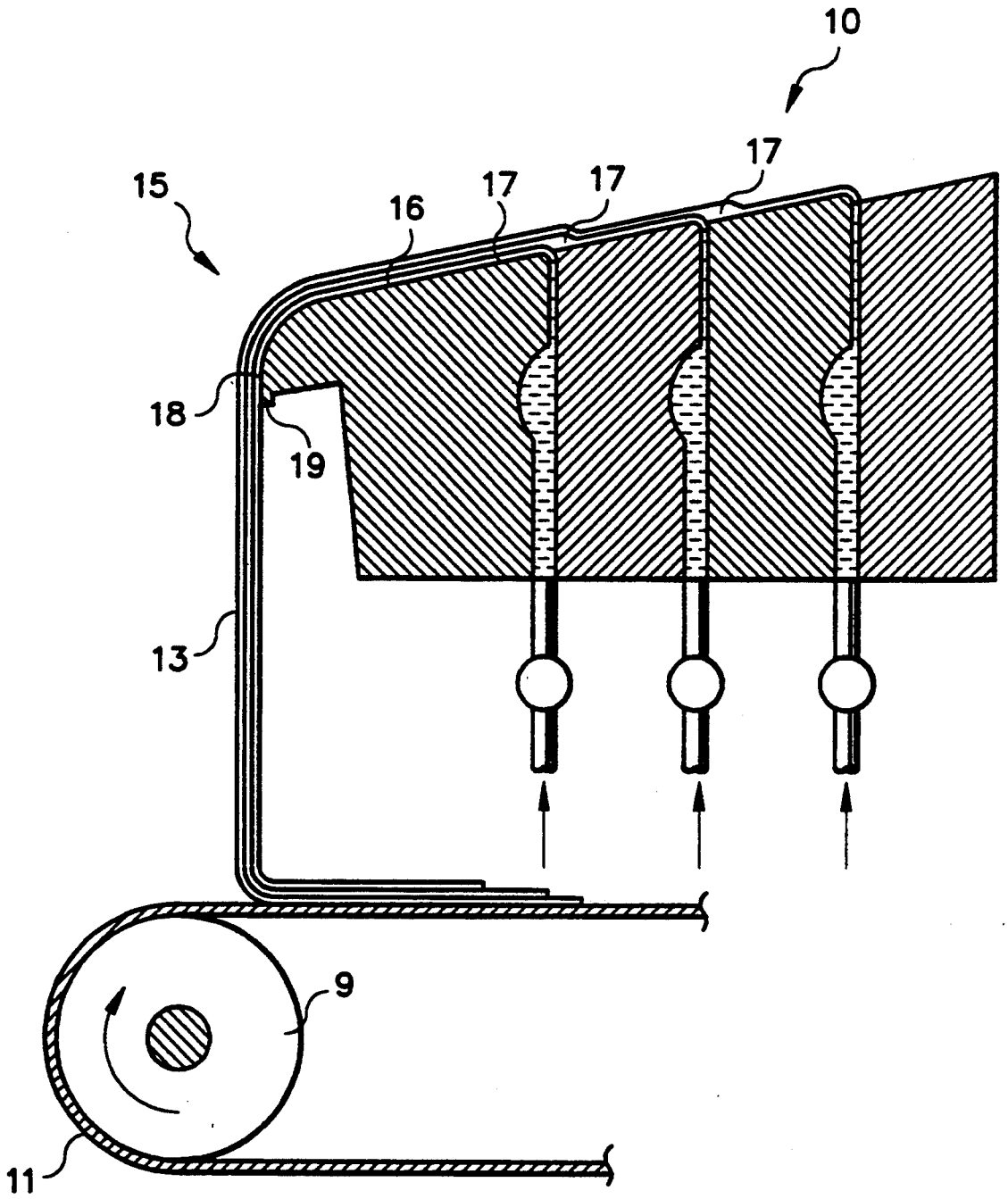
FIG. 1 is a simplified sectional representation of a curtain coating apparatus.

The present invention relates to a coating device as shown in FIG. 1 for coating a traveling web. A web 11 is transported through a coating zone by a backing roller 9. A free falling curtain 13 is formed by layers of liquid flowing down a slide surface 16 at the end of which the surface bends downward to an approximately vertical position. The transition section of the slide surface shown generally by 15 is cylindrical across the width of the slide. In the direction of flow of the liquid layers 17, the transition changes smoothly and continuously in its inclination between the moderately inclined flat section 16 and the flat nearly vertical section 18 ending at the lip 19.

The present invention overcomes the problem of non-uniformity along the sides of the transition section by recognizing that the non-uniformities, i.e. waves, are caused by capillary forces at the edges of the slide. The goal of the present invention is to minimize the effect of the capillary forces. Capillary forces exert pressure on the free surface which is proportional to the free surface's curvature, i.e. the inverse of the radius of curvature. A first approximation of this shape and, therefore the curvature of the free surface, is the underlying slide surface. Thus, a sharp change in curvature in the slide surface as occurs in all the above prior art patents at the end of the transition section, is transmitted to the free surface as a sharp change in pressure near both ends of the transition section. These pressure changes result in relatively large pressure gradients that decelerate or accelerate the flow locally, causing standing waves. The shape (as described by their amplitude, wavelength and decay rate)[1] of the standing waves also depends on the physical properties of the liquid (flow rate, viscosity and surface tension); however, the wave is a response to the sudden change in the slide surface's curvature.

The present invention solves the problem by using a transition profile with a continuous change in curvature. (The radius of curvature lies in plane perpendicular to the ruling of the slide's cylindrical surface.) The axis of the curvature is parallel to the plane of the slide surface. Thus, the transition starts at the end of the moderately inclined section of the slide with the same slope as the slide and with zero curvature (i.e., infinite radius of curvature). The curvature and inclination of the transition section first increase continuously, until the curvature reaches a maximum; and the inclination continues to increase until it is steeply inclined while the curvature decreases. If there is a flat and steeply inclined flat section between the transition section and the discharging lip, the surface profile of the transition section meets it with the same slope as the steeply inclined section and with zero curvature.

The preferred method of designing this surface is to define the way the thickness of the film varies along the transition section, while ensuring that the end conditions for surface curvature are met. Since the waves on the transition section depend on surface tension and inertial forces being present and if we make slow changes in geometry we can eliminate or minimize these waves, then the final shape of the transition section will generally depend on surface tension and inertial forces. Under the assumption that the transition is not too short, then the effects of capillary and inertial forces can be made negligible and the film thickness $\delta$ can be expressed in terms of the angle $\theta$ between horizontal and the slide surface, and the thickness $\delta_0$ and the angle $\theta_0$ on the moderately inclined section of the slide just upstream of the transition section:

$$\delta = \delta_0\left(\frac{\sin\theta_0}{\sin\theta}\right)^{\frac{1}{3}} \tag{1}$$

The curvature (1/R) of the free surface can be related to the angle $\theta$ and the distance of arclength s along the transition surface by the differential equation $1/R = d\theta/ds$. By combining this with eq. (1), an expression can be obtained relating curvature, film thickness and angle of inclination:

$$\frac{1}{R} = -3\frac{\tan\theta}{\delta}\frac{d\delta}{ds} \tag{2}$$

Figure 2:
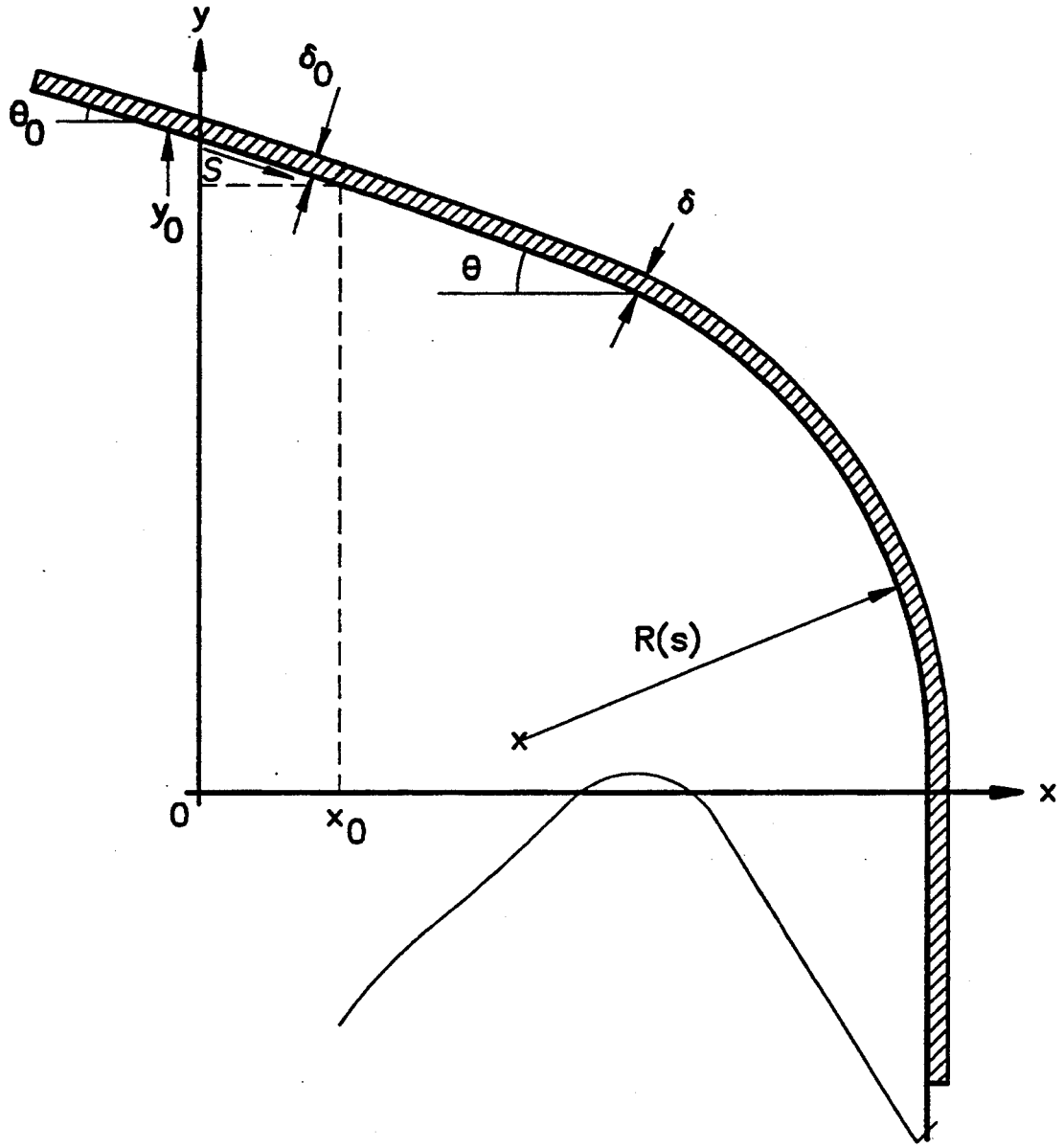
FIG. 2 is a detailed representation of a preferred shape of the transition section of the present invention.

A formulation that provides the same information as in equation 2, but is more convenient for manufacturing the section is obtained by converting the above relationship to Cartesian coordinates, with x and y being the horizontal and vertical coordinates shown in FIG. 2. The relationships between x and y, and $\theta$ and s are given by the differential equations $dx/ds=\cos\theta$ and $dy/ds=-\sin\theta$. Combining these with equation 1, the transition surface is defined in Cartesian coordinates:

$$x(s) = x_0 + \int_0^s \sqrt{1-\frac{\delta_0^6\sin^2\theta_0}{\delta^6(s')}}\,ds \tag{3a}$$

-continued $$y(s) = y_0 - \delta_0^3 \sin\theta_0 \int_0^s \frac{ds'}{\delta^3(s')} \quad (3b)$$

where L is the arclength of the curved surface of the transition section, and $x_0$ and $y_0$ are the coordinates of point where the transition section starts. Also in equations 3(a) and 3(b) s is the limit on the integral and s' is a dummy variable.

Thus, once the thickness ratio $\delta/\delta_0$ of the film is defined along the transition section, the profile of the transition section can be determined. A condition the thickness profile must obey at both ends is that its slope ($d\delta/ds$) be zero. This is required by equation 2 to satisfy the zero curvature condition at both ends. A preferred functional form for film thickness ratio satisfying the slope conditions and thickness condition at both ends of the transition section is:

$$\frac{\delta}{\delta_0} = \left(\frac{\sin\theta_0}{\sin\theta_1}\right)^{\frac{1}{3}} + \left[1 - \left(\frac{\sin\theta_0}{\sin\theta_1}\right)^{\frac{1}{3}}\right]\left(1 - \frac{s}{L}\right)^{2+n}\left[(2+n)\frac{s}{L} + 1\right] \quad (4)$$

where $\theta_1$ is the angle of the steeply inclined section. The parameter n must be greater than zero. The curvature is obtained by combining eqs. (2) and (4):

$$\frac{1}{R} = \frac{3\tan\theta}{L} \frac{(2+n)(3+n)\left[\left(\frac{\sin\theta_1}{\sin\theta_0}\right)^{\frac{1}{3}} - 1\right]\left(1 - \frac{s}{L}\right)^{1+n}\frac{s}{L}}{1 + \left[\left(\frac{\sin\theta_1}{\sin\theta_0}\right)^{\frac{1}{3}} - 1\right]\left(1 - \frac{s}{L}\right)^{2+n}\left[(2+n)\frac{s}{L} + 1\right]}$$

Positive curvatures refer to convex surface shapes. Equations 4 and 5 are only valid when the steeply inclined section has an angle $\theta_1$ to the horizontal of 90° or less. The above equation generates a family of surface profiles with two parameters: the exponent n and the arclength of the transition section L. These two parameters must be within a certain range to be acceptable. The parameter n determines the location of maximum curvature as a function of s/L. The parameter n must be greater than zero and as n grows the maximum curvature moves from the steeply inclined end towards the moderately inclined end. Values of n less than 10 are acceptable, while those between 0.25 and 2 are preferred. The acceptable size of the arclength L depends in part on the flow conditions. For the range of operating conditions tested here, i.e., flow rates of 1 to 6 $cm^3$/sec/cm, viscosities of 0.005 to 0.12 Pa.s, and surface tensions of 0.02 to 0.07 N/m, the arclength L has an acceptable range of 5 to 100 mm, with preferred performance in the range of 15 to 45 mm. FIG. 2 shows the transition section of n=1.25 and L=20 mm, which is the preferred embodiment.

Five examples are presented here. For easy comparison the flow rate and viscosity in all cases is approximately the same, 3 $cm^3$/sec/cm and 0.06 Pa.s, respectively. The first two examples are for transition sections made from circular cylinders of two different curvatures. The moderately and steeply inclined slide sections are 15° and 90° to the horizontal, respectively. The remaining are embodiments of this invention, of cylindrical profiles with variable curvature using equation 5 to define the curvature.

EXAMPLE 1

Figure 3:
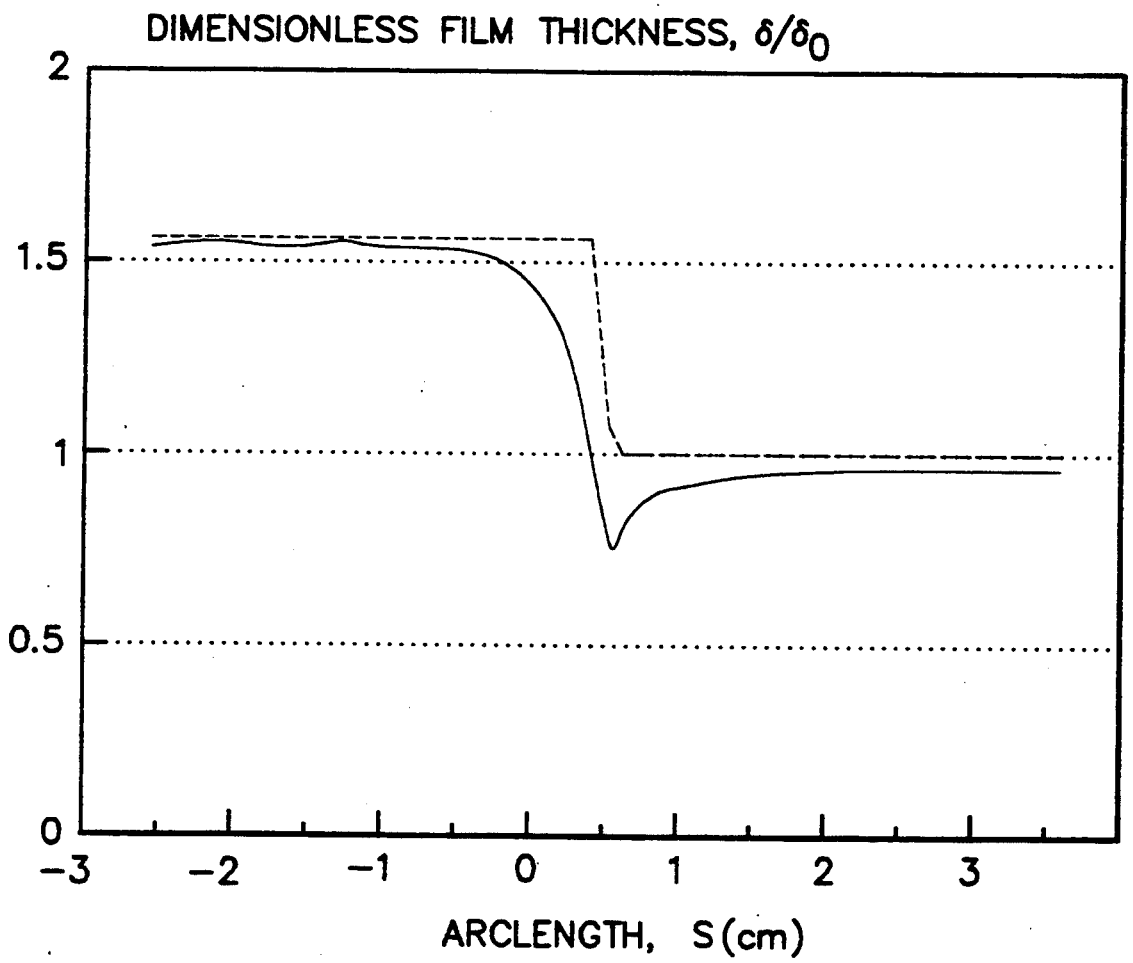
FIGS. 3, 4, 5, 6 and 7 show measured profiles of film thickness and stipulated edge pad heights along the transition sections used in Examples 1–5.

This example is of the flow over a transition section which is part of a circular cylinder of small radius of curvature, R=1.6 mm. The transition section is installed in the slide of a hopper such as shown in FIG. 1. The liquid film thickness is measured along the transition section and in the flat sections of the slide immediately adjacent to it. FIG. 3 shows the measured thickness of the film (thick line) and the thickness predicted using eq. (1) (broken line). The abscissa (x-axis) is the length of the arc s along the slide surface, with the origin at the starting point of the transition section, measured in cm. The ordinate (y-axis) is the dimensionless film thickness, i.e., the ratio of film thickness $\delta$ to the final thickness $\delta_1$. The final film thickness is calculated from the formula $\delta_1 = (3\mu Q/\rho g)^{\frac{1}{3}}$, where Q, $\mu$, and $\rho$ are respectively the flow rate per unit width, viscosity and density of the liquid and g is the gravitational constant. It is clear that an edge pad designed using eq. (1) always under predicts the thickness on the transition section. Furthermore, the film thickness along the transition section is over predicted by up to about 40% of the actual thickness. Edge pads of the predicted size will create large nonuniformities along the coating's edges. Moreover, the shape of the free surface changes with other flow conditions, and the region of change is very short, making it very difficult to produce the edge pad.

EXAMPLE 2

Figure 4:
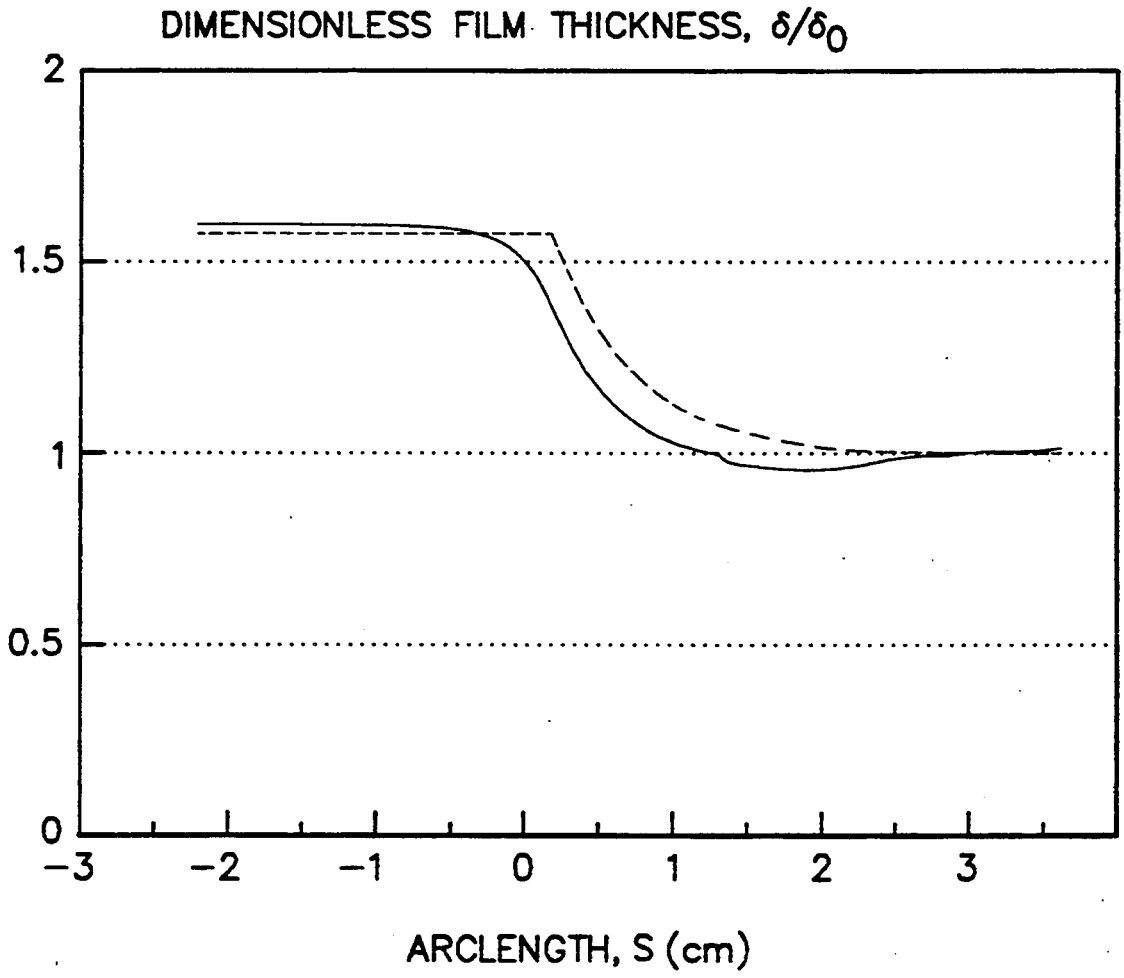

FIG. 4 shows the same profiles for the case when the transition section is a circular cylindrical surface of radius 12.7 mm. Although the experimental profile follows the predictive curve much better than in example 1, the free surface anticipates the beginning of the circular section (the sharp bend in the predictive curve) quite significantly and also produces a small dip at the end of the transition section.

Several problems arise with this section. If one were to use eq. (1) to stipulate the height of the edge pad, the error in height for this flow condition is moderate, less than about 15% in final thickness. However, the rapid change in the difference between the actual thickness and the design height of the edge pad at the beginning of the transition section (where the height discrepancy is greatest) will affect the uniformity of the coating. Development work with edge pads has shown that abrupt changes in edge pad height are detrimental because of the resulting meniscus shape, and also because residues of the coating liquids build up there first. However, it seems reasonable that smooth changes in the difference between the film thickness and the height of the edge pad are preferable to rapid changes, even when these are small enough in magnitude that the pad's height remains substantially the same as the liquid's thickness. The edge pad height could probably be tailored for this flow by filing it down, for example. However, the variation in film thickness for other flow conditions (with the same initial thickness) will have different wave shapes at this point, so a standard edge pad for the transition section would be unsatisfactory.

EXAMPLE 3

Figure 5:
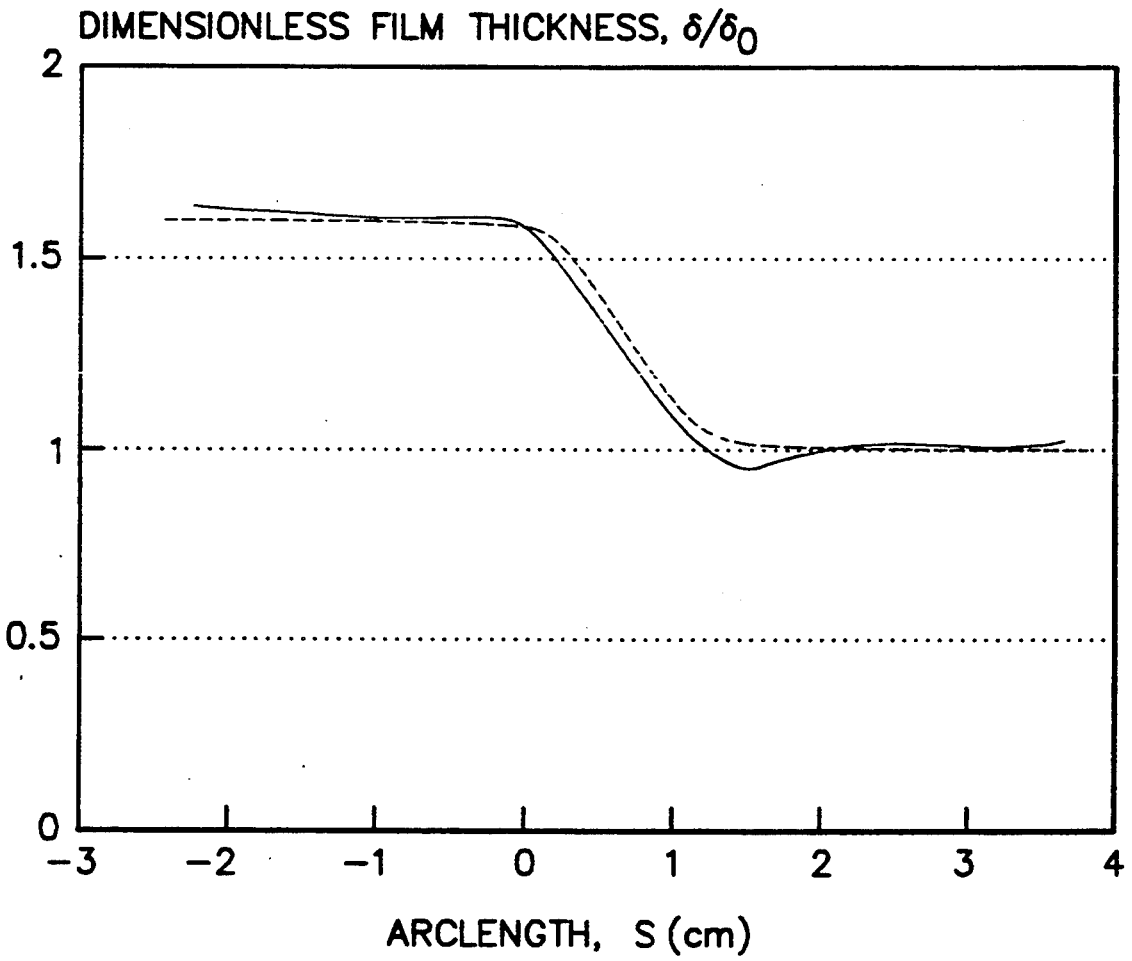

The transition section in this example is generated with eq. 5, using n=0.5 and L=16.6 mm. The arclength of the transition section is substantially the same as the circular section of Example 2, so it exposes the film to about the same risk of air and interfacial instabilities. FIG. 5 shows the thickness profiles. Here the experimental and predictive film thicknesses agree with each other significantly better than in the previous example. The wave near the beginning of the transition section is absent. This is because the curvature and the inclination increase very slowly at the beginning. In fact, eq. 1 shows that film thickness is much more sensitive to the angle of inclination when it is small (i.e. $\theta$ near zero) than when it is large ($\theta$ near 90°); thus, for a smooth progression in film thickness, the inclination must change more slowly when it is small compared to when the inclination is large. The most important discrepancy is near the end of the transition section. This is caused by the maximum curvature of the transition section, which occurs near that end. Experiments with other flow conditions show similar improvements.

EXAMPLE 4

Figure 6:
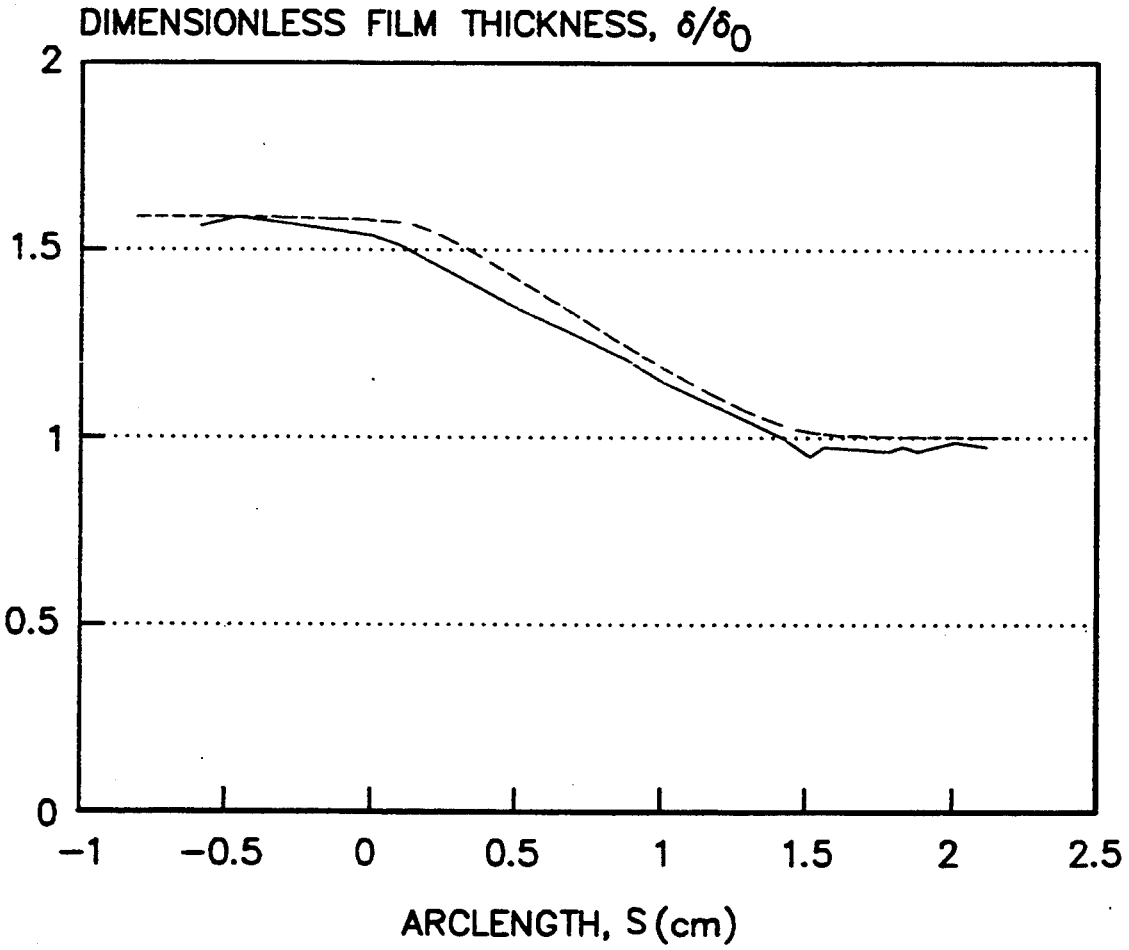

Another transition section generated with eq. (5) uses n=1.25 and L=20.0 mm, an increase in both parameters from those in Example 3. Increasing parameter n moves the point of maximum curvature away from the nearly vertical end of the transition section, thus eliminating the lower thinning wave. Increasing the arclength ensures that the change in the inclination near the beginning of the transition section remains about as small as in Example 3. FIG. 6 shows the thickness and the predicted or design edge pad height profiles for this case. The agreement between the measurement and the design is good over the entire transition section, including where it meets the nearly vertical section. (In fact, the relatively small but consistent discrepancy between the two could be due to a systematic error in the measurement.) For other flow conditions we find that the experimental thickness varies smoothly around the design profile with a maximum error of approximately 10% of the total thickness.

EXAMPLE 6

Figure 7:
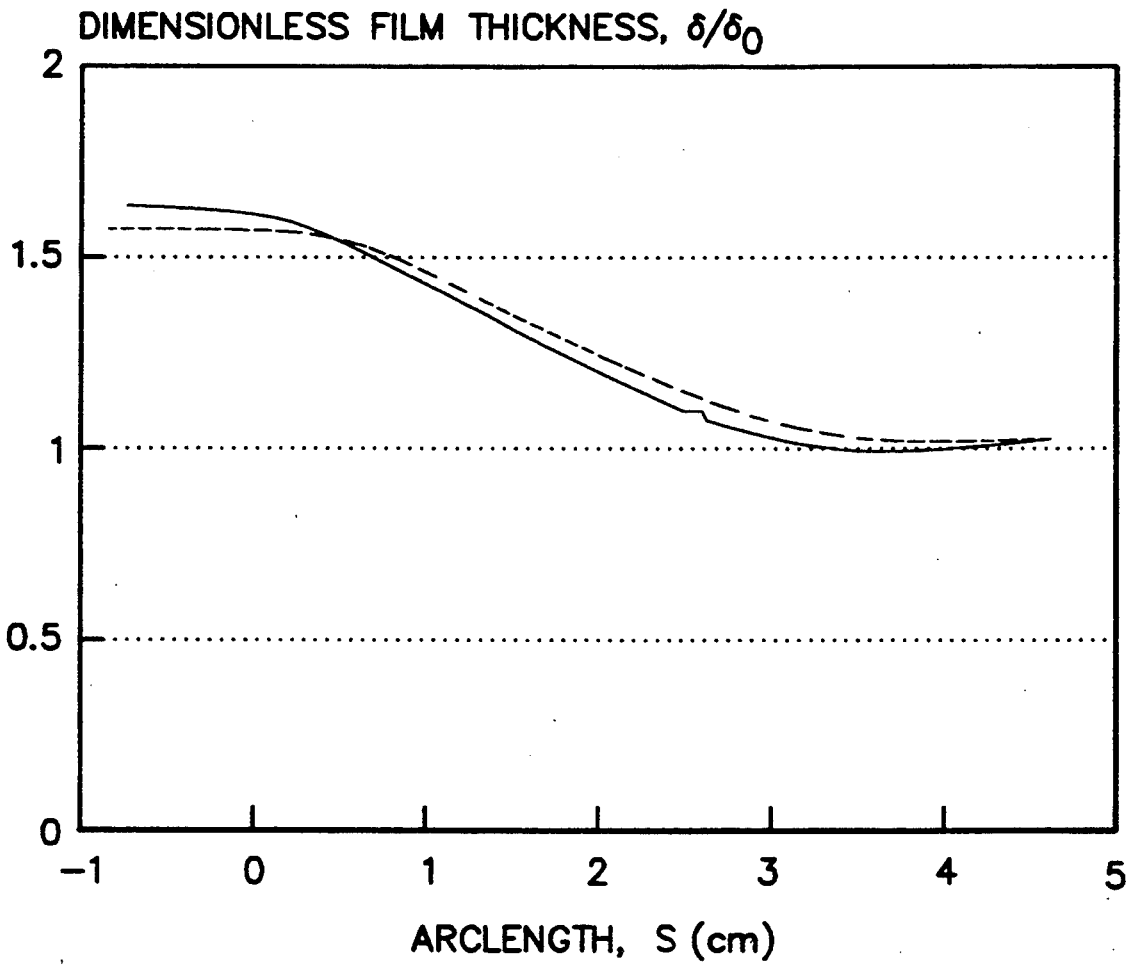

A third transition section generated with eq. (5) uses n=1.00 and L=42.2 mm. FIG. 7 shows the measured film thickness and design edge pad heights. The two curves agree the best. (The higher measurement curve on the left or upstream end is caused by liquid emerging from the slot which is in this case immediately upstream of the transition section. At the point where the measurement is taken, the flow is still accelerating and has not fully developed.) The improvement over the results of Example 4, however, is marginal, and the risk increases of deteriorating the uniformity through interfacial wave instability and air disturbances. Thus this transition section is less satisfactory than the previous one.

The present invention describes a curtain coater with a transition section that has a continuously variable curvature. The invention provides smooth and predictable changes in the thickness of the liquid film as it flows from the inclined section of the slide surface to the nearly vertical section of the slide surface on a curtain coating hopper. This allows a reduction in the number of edge pads required for the transition section on coaters when operating conditions change. The present invention also provides the ability of performing a smooth transition over a shorter section than in prior art devices. Because of the predictability of the film thickness, it is easier to manufacture edge guides that reliably produce uniform edges. Finally, greater stability of the curtain at lower flow rates than is possible with the smaller radius of curvature transition sections is achieved with the present device. This has been demonstrated in the work of the present invention and is in agreement with the observations in U.S. Pat. No. 4,109,611.

While there has been shown what are at present considered to be the preferred embodiments of the invention, various modifications and alterations will be obvious to those skilled in the art. All such modifications are intended to fall within the scope of the appended claims.

What is claimed is:

1. A method for determining a profile of a transition surface for a coating hopper for curtain coating a moving support with one or more layers of a coating liquid comprising:

providing a hopper having a slide surface and a lip surface, the lip surface terminating at a lip for forming a free falling curtain of coating liquid, the hopper means having a transition surface connecting the slide surface at a first end and the lip surface at a second end, the transition surface profile having a variable curvature that is zero at the first end, increases continuously to a maximum at a point between the first and second end and decreases continuously to zero at the second end, the transition surface having a length L and the variable curvature determined by the following formula:

$$\frac{1}{R} = \frac{3\tan\theta}{L} \frac{(2+n)(3+n)\left[\left(\frac{\sin\theta_1}{\sin\theta_0}\right)^{\frac{1}{3}} - 1\right]\left(1-\frac{s}{L}\right)^{1+n}\frac{s}{L}}{1+\left[\left(\frac{\sin\theta_1}{\sin\theta_0}\right)^{\frac{1}{3}} - 1\right]\left(1-\frac{s}{L}\right)^{2+n}\left[(2+n)\frac{s}{L}+1\right]}$$

wherein

R=the variable radius of curvature such that a positive value of R defines a convex surface;

$\theta$=the local angle of inclination of the slide with respect to the horizontal;

$\theta_0$=the angle of inclination at the first end of the transition surface;

$\theta_1$ =the angle of inclination at the second end of the transition surface less than or equal to 90°;

s=the arc length distance along the transition surface, starting at the first end;

L=the arc length of the entire transition surface; and n=a positive number and then apply said coating to the moving support from the coating hopper in the form of a curtain.

2. The method according to claim 1 wherein:

n is less than 10; and

L is from about 5 to 100 mm.

3. An apparatus for curtain coating a moving support with one or more layers of a coating liquid comprising:

hopper means having a slide surface and a lip surface, the lip surface terminating at a lip for forming a free falling curtain of coating liquid, said hopper means having a transition surface connecting the slide surface at a first end and the lip surface at a second end, the transition surface profile having a variable curvature that is zero at the first end, increases continuously to a maximum at a point between the first and second ends and decreases continuously to zero at the second end.

4. The apparatus according to claim 3 wherein the transition surface has an arclength L and the variable curvature is determined by the following formula:

$$\frac{1}{R} = \frac{3\tan\theta}{L} \frac{(2+n)(3+n)\left[\left(\frac{\sin\theta_1}{\sin\theta_0}\right)^{\frac{1}{3}} - 1\right]\left(1-\frac{s}{L}\right)^{1+n}\frac{s}{L}}{1+\left[\left(\frac{\sin\theta_1}{\sin\theta_0}\right)^{\frac{1}{3}} - 1\right]\left(1-\frac{s}{L}\right)^{2+n}\left[(2+n)\frac{s}{L}+1\right]}$$

wherein

R = the variable radius of curvature such that a positive value of R defines a convex surface;

$\theta$ = the local angle of inclination of the slide with respect to the horizontal;

$\theta_0$ = the angle of inclination at the first end of the transition surface;

$\theta_1$ = the angle of inclination at the second end of the transition surf-ace less than or equal to 90°;

s = the arclength distance along the transition surface, starting at the first end;

L = the arclength of the entire transition surface; and n = a positive number.

5. The apparatus according to claim 4 wherein:

n is less than 10; and

L is from about 5 to 100 mm.

6. The apparatus according to claim 5 wherein:

n is between 0.25 and 2; and

L is approximately 15 to 45 mm.

7. The apparatus according to claim 3 wherein the hopper means further comprises metering slots positioned across the slide surface for providing coating liquid to the slide surface.

8. The apparatus according to claim 3 wherein the length of the transition surface is approximately 5 to 100 mm in length.

9. The apparatus according to claim 3 wherein the slide surface is inclined approximately 5° to 30° from horizontal.

10. The apparatus according to claim 3 wherein the lip surface is 60° to 120° from horizontal.

* * * * *